United States Patent [19]

Hoyt

[11] Patent Number: 4,677,928

[45] Date of Patent: Jul. 7, 1987

[54] CIRCULAR LINKED ROTATING FOIL ASSEMBLY FOR VESSELS

[76] Inventor: John G. Hoyt, One Harborview Dr., Newport, R.I. 02840

[21] Appl. No.: 845,837

[22] Filed: Mar. 28, 1986

[51] Int. Cl.[4] ..... B63H 9/06

[52] U.S. Cl. ..... 114/39; 114/103; 244/34 A

[58] Field of Search ..... 114/103, 39.2, 39.1, 114/39, 102; 244/34 A, 45 R

[56] References Cited

U.S. PATENT DOCUMENTS 2,951,661 9/1960 Dorman et al. ..... 244/34 A X 3,154,269 10/1964 Musil ..... 244/34 A

FOREIGN PATENT DOCUMENTS 1423958 12/1966 France ..... 114/39.1

1484739 6/1967 France ..... 114/39.1

*Primary Examiner*—Sherman D. Basinger

*Attorney, Agent, or Firm*—Barlow & Barlow

[57] ABSTRACT

A sailing craft has a circular linked rotating structure mounted on a vertical support or mast and within the circular structure are a plurality of parallel thin foils. The entire circular structure may be rotated in two axes to achieve directional control of the sailing craft as well as to adjust the angle of the foils to the wind.

4 Claims, 12 Drawing Figures

CIRCULAR LINKED ROTATING FOIL ASSEMBLY FOR VESSELS

BACKGROUND OF THE INVENTION

This invention relates to a particular foil sail for vessels and more particularly to a rotating foil arrangement that employs a plurality of parallel elongated narrow vanes. In small sailing craft, and particularly in sailboards, as for example those illustrated in U.S. Pat. No. 3,487,800, it is common to employ a single triangular cloth sail which can be carried freely at various angles to the wind as a result of a universal joint at the base of the mast. When angled to windward and back, this rig is capable of simultaneously creating forward and upward lift, and the successful combination of these two forces has improved upon the conventional rigs as evidenced by the fact that the sailboard rig now holds the monohull speed record of over 35 knots. Efforts have been made to improve the lift performance of sails by improving rigidity, smoothness, and using high aspect ratio for better results. Thin, rigid, single high aspect ratio air foils have not been too successful because the height necessary to achieve the required sail area makes these rigid foils very difficult to control. In addition, a single foil requires some stiffening agents such as a mast to supply enough rigidity for control. It has accordingly been difficult to improve upon the present sail arrangements of a mast with synthetic cloth, highly tensioned by battens and using a wishbone boom which creates in effect a sail that is a very taut membrane and which is quite efficient.

SUMMARY OF THE INVENTION

The instant invention is directed to a series of foils that are joined together at each end by a circular structure which in one embodiment is itself an airfoil, the entire structure being capable of providing upward and forward lift when correctly angled to the wind. Simply stated, foils in a horizontal attitude provide upward lift while foils in a vertical attitude provide forward and upward lift. The foils that are utilized have a high aspect ratio and are thin to give high aerodynamic efficiency. It is known, for example, that the efficiency of an airfoil is dependent upon its aspect ratio which can be defined by the formula $s^2/a$, where "s" is the length of the foil and "a" is its area. Also, it is known that with a higher aspect ratio, the greater the coefficient of lift. The entire rig utilizes the principle of keeping a low coefficient of drag by using long, narrow foils. The entire foil structure is designed to be rotated both angularly with respect to the center line of the sailing vessel, as well as rotationally to change the attitude of the foils with respect to the wind and to vary the lift characteristics. In this configuration, the multiple foils may be neutralized by swinging them into a horizontal mode where all the lift is upward, or angling them downward from the horizontal to acquire forward lift. Such an arangement enables an operator to effectively reduce sail area by progressively swinging the rig more into a horizontal mode which directly reduces the heeling moment and converts that force to a useful upward lift.

DESCRIPTION OF THE DRAWINGS

FIGS. 4A, B, C, and 5A, B, C, D, are diagramatic views illustrating the various attitudes that the rig can be used in.

DETAILED DESCRIPTION OF THE PREFERRED EMBODIMENTS

Figure 1:
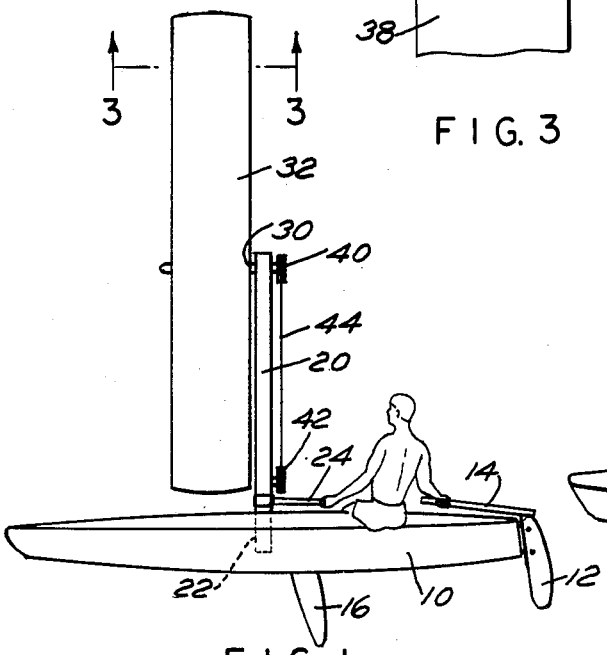
FIG. 1 is a side elevational view of a sailing craft fitted with the rotating foil rig.
Figure 3:
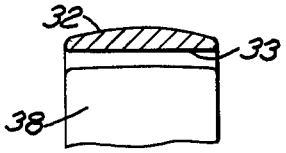
FIG. 3 is a sectional view taken on lines 3—3 of FIG. 1.
Figure 2:
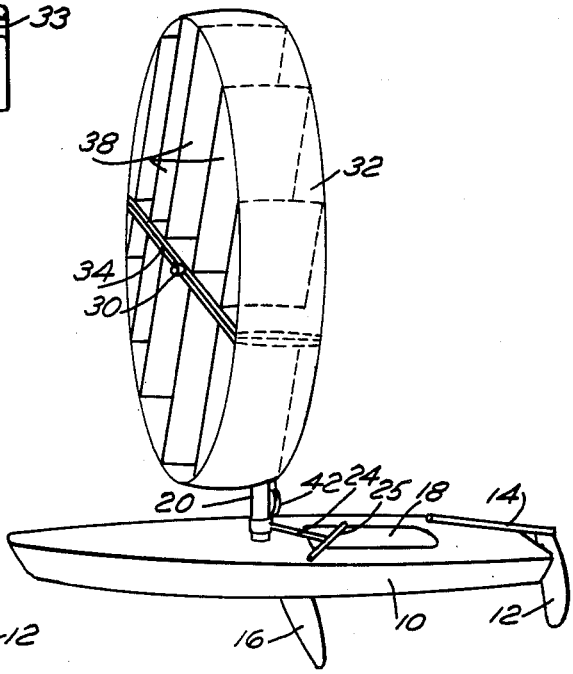
FIG. 2 is a perspective view thereof.

Referring to the drawings, there is illustated in FIG. 1 a sail boat hull 10 having a rudder 12 with tiller 14 and for lateral stability, a centerboard 16. The sailboat has the usual cockpit 18 and just forward of the cockpit and forward of the centerboard there is mounted an upright support 20 which might also be termed a "mast". The upright support is received in a socket 22 within the sailboat hull, the mast preferably passing through the deck and into a mast step (not shown). To provide rotational motion to the mast, there is illustrated a laterally extending handle 24 which may have suitable extensions such as 25 thereon. Alternately, mast rotation may be obtained at the base of the mast by affixing various mechanical means such as quadrants with cable control or other devices known to the skilled shipbuilder.

Mounted at the upper end of the upright support or mast 20, is a shaft 30 that passes through the mast, and on the end of shaft 30 there is fitted a circular air foil 32 having a wall with a flat inner surface 33 to which a diametral support plate 34 is secured, the plate serving as the rigid mounting point for the shaft 30. Mounted in spaced positions along the diametral support 34, are a plurality of airfoils 38 that extend in parallel relationship between the diametral support and the circular foil. Rotation of the circular air foil is provided by any suitable means, here illustrated as a sheave 40 mounted on the shaft 30 and a second sheave 42 mounted near the base of the mast to provide not only rotational support by means of suitable cable such as 44, but also the lower sheave 42 is provided with a suitable braking system to maintain the rotational attitude of the circular foil.

Figure 4A:
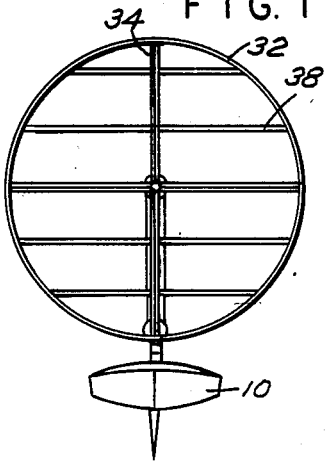
Figure 4B:
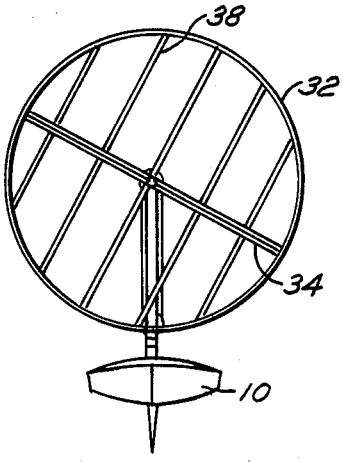
Figure 4C:
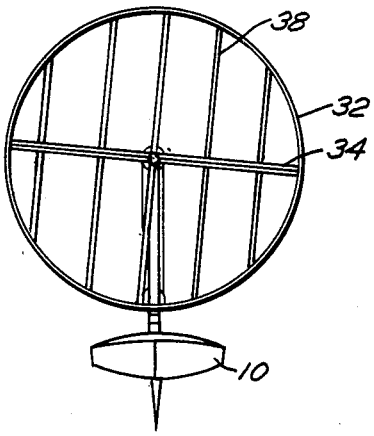
Figure 5A:
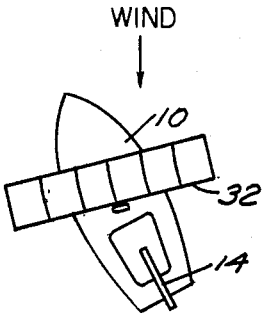
Figure 5B:
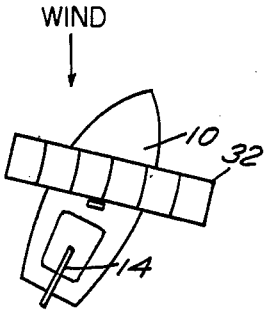
Figure 5C:
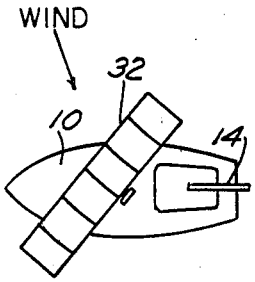
Figure 5D:
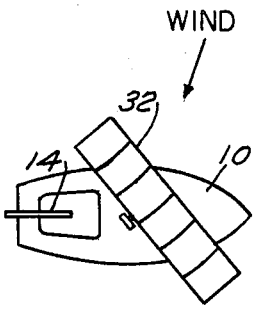

Referring now to FIG. 4, it can be seen in FIG. 4A that the foils are arranged horizontally and in this condition there will be no forward force created, merely an upward lift and the boat essentially can be maintained at a mooring or at anchor. In FIG. 4B, the foils are shown at a partial angle to the vertical to achieve a driving force forward in moderate air. To move up wind, references had to FIGS. 5A and 5B where the angle of the wind to the angle of the entire circular foil rig is illustrated for both starboard and port tack arrangements. The illustration in FIG. 4C shows the foils vertical which would be used when the wind is fairly light, it being understood that as the wind increases, the foils are rotated more to the horizontal to decrease the heeling moment and increase the upward lift. FIGS. 5C and 5D show the manner in which the foils will be oriented on a broad reach, the angle of the entire structure being made more oblique to the hull than when one is trying to tack up wind.

Essentially the invention thus far described provides the neccessary sail area by stacking a number of smaller high aspect ratio foils within a circular structure or duct which is formed by virtue of the fact that the circular structure itself is a foil. In this way, the incoming wind is channeled productively and the duct or the circular structure provides the foils with a beneficial end plate effect that reduces tip turbulance and improves lift. Further, containing the foils within the circular duct creates a very rigid structure which enables all the parts to be thin and light, features which directly enhance the air-dynamic efficiency.

Figure 6:
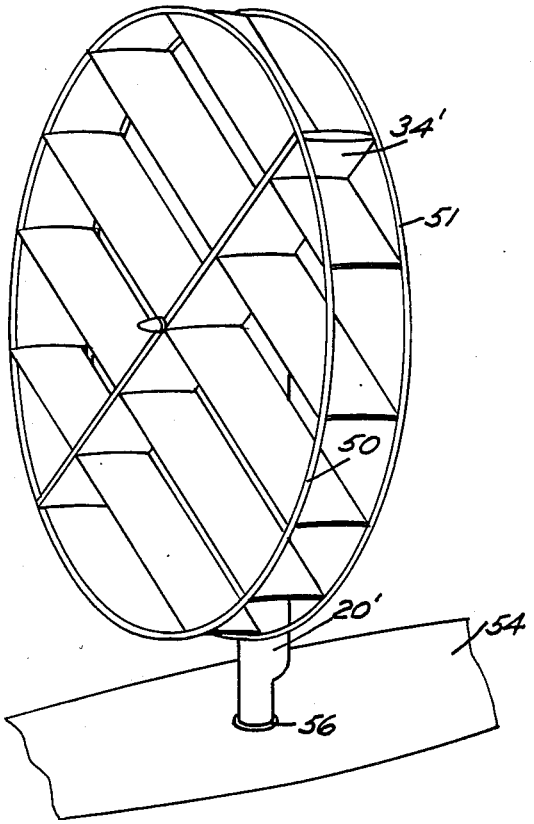
FIGS. 6 and 7 are perspective views of a modified form.
Figure 7:
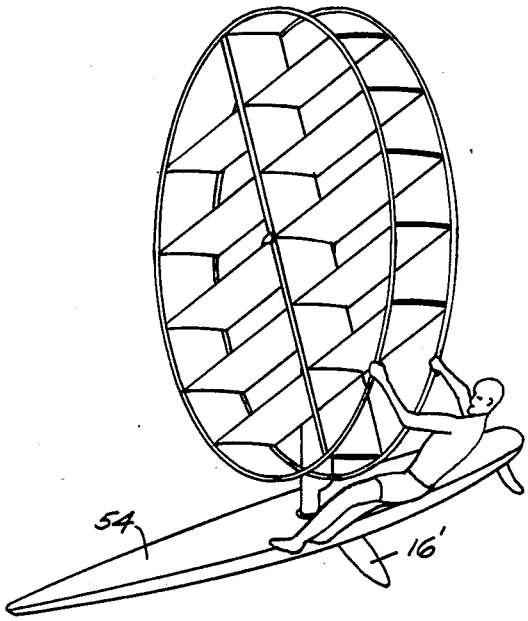

Referring to FIGS. 6 and 7, there is illustrated a second form of circular duct which is composed of two circular rims 50, 51 which is advantageous if the rig is to be used on a sailboard 54. In this embodiment, the support 20' is freely rotatable in a socket 56 in the board 54 but in other respects is identical to the above described embodiment. The two rims 50, 51 are adequate for providing structural rigidity and have the advantage of greater lightness and ease of holding as seen in FIG. 7. The arrangement loses some of the aerodynamic efficiency of the solid band, yet still provides some end plate effect.

I claim:

1. A sailing craft having an upright support received for rotation in said craft, a circular structure having an inner surface, a diametrical support extending across the structure and between the inner surface of the circular structure, means connecting the diametral support to said support for rotative movement, a plurality of parallel foils fixedly mounted within said structure between the diametral support and the inner surface of said circular structure, said circular structure providing end plate effect for said foils, control means for controlling the rotative movement of the diametral support and for controlling the rotative position of the upright support.

2. A sailing craft as in claim 1 wherein said plurality of foils are of stiff material to impart structural stiffness to the circular structure.

3. A sailing craft as in claim 1 wherein the circular structure is an airfoil and has a flat inner surface and a curved outer surface.

4. A sailing craft as in claim 1 wherein the circular structure is a pair of spaced circular rims.

* * * * *